United States Patent [19]

Elmalek et al.

[11] Patent Number: 5,075,912

[45] Date of Patent: Dec. 31, 1991

[54] METHOD OF TAKING IMPRESSIONS FOR A BED

[75] Inventors: Pierre Elmalek, Paris; Guy Nathan, Vanves, both of France

[73] Assignee: Vieux Chene Expansion Sarl, Montmagny, France

[21] Appl. No.: 351,233

[22] Filed: May 15, 1989

[30] Foreign Application Priority Data

May 25, 1988 [FR] France ..... 88 06912

[51] Int. Cl.[5] ..... A47C 23/06; A47C 31/12

[52] U.S. Cl. ..... 5/236.1; 5/11; 5/60; 5/191

[58] Field of Search ..... 5/236.1, 191, 238, 11, 5/60

[56] References Cited

U.S. PATENT DOCUMENTS 4,650,247 3/1987 Berg et al. ..... 297/284

FOREIGN PATENT DOCUMENTS 0111898 12/1983 European Pat. Off. .

0213332 3/1987 European Pat. Off. .

34004425 8/1985 Fed. Rep. of Germany .

*Primary Examiner*—Alexander Grosz

*Attorney, Agent, or Firm*—Lowe, Price, LeBlanc & Becker

[57] ABSTRACT

Impressions for a bed having slats and spring supports for applying differing upwardly directed forces to bottom surfaces of different ones of the slats are taken while a user of the bed is in a recumbent position on an under mattress of an impression taking bed supported by slats. Slats of the impression taking bed are supported by springs of the type which support the slats of the bed to be used. The vertical position of differing ones of the spring supports of the impression taking bed are modified to a position compatible with the user while the user is on the impression taking bed. The vertical position is modified with respect to an initial adjustment position of the springs for slats of the impression taking bed. The amount of which the vertical position was modified for the springs of the impression taking bed is recorded to enable the vertical position of the spring-like support means of the bed to be used to be controlled.

17 Claims, 3 Drawing Sheets

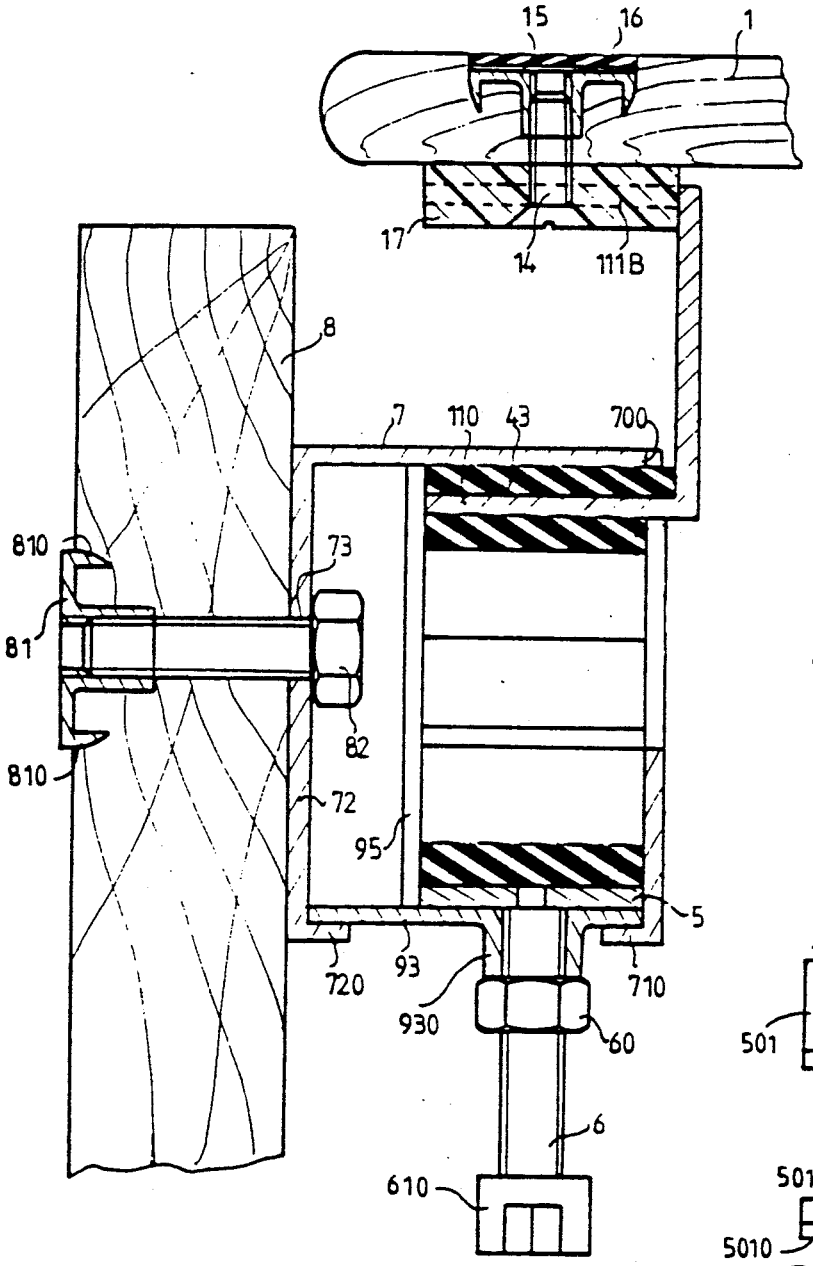
FIG. 3
FIG. 3A
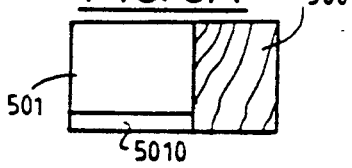
FIG. 3B
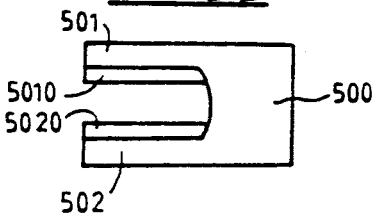

METHOD OF TAKING IMPRESSIONS FOR A BED

The present invention relates to method of taking impressions for slatted under mattresses.

BACKGROUND OF THE INVENTION

Under mattresses for slatted beds are of two kinds, either with slats having adjustable rigidity, or with slats having fixed rigidity.

For slatted beds with adjustable rigidity, the rigidity of the slat itself is modified empirically by the user trying it. Because of the location of the slat rigidity adjusting means, this method is impractical. It requires multiple attempts and much trial and error to succeed in satisfying the comfort of the user.

SUMMARY OF THE INVENTION

An object of the present invention is to provide a method of permitting a user lying on a bed to take impressions, to modify at his leisure the rigidity of the articulation of each slat so as to obtain a support in accordance with his morphology or maximum comfort of the user.

Another object of the invention is to provide a method of adjusting the rigidity of an impression-taking under-mattress to determine adjustments to be made to a bed to be delivered.

A further object of the invention is to provide a new method of adjusting a bed to be delivered.

In accordance with one aspect of the invention, impressions for a bed to be used having slats and spring-like support means for applying differing upwardly directed forces to bottom surfaces of different ones of the slats are taken while a user of the bed is in a recumbent position on an under mattress of an impression taking bed supported by slats. The slats of the impression taking bed are supported by spring-like support means of the type which supports the slats of the bed to be used. The method comprises modifying the vertical position of differing ones of the spring-like support means of the impression taking bed to a position compatible with the user while the user is in said position on the impression taking bed. The vertical position is modified with respect to an initial adjustment position of the spring-like means for slats of the impression taking bed. The amount by which the vertical position was modified for the spring-like support means of the impression taking bed to enable the vertical position of the spring-like support means of the bed to be used to be controlled is recorded.

In accordance with a further aspect of the invention, maximum comfort is provided to a user of a bed including an under mattress, plural slats supporting the under mattress, and means for adjusting vertical support forces applied to the slats by causing the user to be in a reclining position on an under mattress of a test bed different from the bed to be used by the user. The test bed includes plural slats supporting the under mattress, as well as means for monitoring the force exerted on the test bed slats by the user, and means for adjusting vertical support forces applied to the test bed slats. While the user is in the reclining position on the test bed, adjustments are made to the vertical support forces exerted on the test bed slats which enable the user to have maximum comfort by activating the force adjusting means of the test bed. The vertical support forces exerted on the test bed slats which enable the user to have maximum comfort are monitored. An indication of the monitored forces applied to the slats of the test bed for use in controlling the adjusting means of the bed to be used are recorded to provide similar forces to the slats of the bed to be used.

In a preferred embodiment, the means for adjusting the forces applied to the slats of the test bed includes a vertically extending spring-like member having a confined lower end and a confined upper end from which extends a rigid structure connected to drive one of the tested slats. The vertically directed force exerted on the slats of the test bed by the means for supporting is modified by adjusting the vertical position of the confined lower end of the spring-like member. In addition, the lower end vertical position of the spring-like member of the test bed is adjusted by activating a motor for driving the lower end to determine the correct position of the lower end relative to an initial lowest position for the spring-like member of the test bed. Slats in the bed to be used are adjusted by biasing the lowest end of spring-like members of the bed to be used. Preferably, the lower end of the spring-like members of the bed to be used is biased by providing a shim having a geometry to attain the correct bias. The lower end of the spring-like member of the bed to be used is translated away from the initial lowest position therefor. The shim is inserted into the bed to be used between the lower end of the spring-like member and a structure defining the initial lowest portion for the spring-like member.

The lower end can also be biased by translating a plate away from a member defining the initial position of the lower end of the spring-like portion. The plate is translated by turning a screw to which the plate is fixedly mounted.

The means for adjusting the bed to be used is preferably controlled so vertical forces on the slats of the bed to be used are substantially the same as the monitored vertical support forces on the slats of the test bed. In the preferred embodiment, the means for adjusting the vertical support forces applied to the test bed and the bed to be used include, for each bed, a separate vertically extending spring-like member having a confined lower end and a confined upper end from which extends a rigid structure connected to drive a slat of the particular bed. The vertical position of the confined lower end of the spring-like member of the test bed is adjusted to provide the vertical support forces on the test bed slats which enable the user to have maximum comfort. The monitored force is indicated by the vertical position of the lower end of the test bed spring-like structure. The vertical position of the confined lower end of a spring-like member of the bed to be used is adjusted so it conforms substantially with the vertical position of a corresponding slat of the test bed as determined during the monitoring step.

Preferably, the lower end vertical position of the spring-like member of the test bed which results in maximum comfort is adjusted by activating a motor for driving the lower end to determine the correct position of the lower end relative to an initial lowest position for the spring-like member of the bed to be used.

BRIEF DESCRIPTION OF THE DRAWINGS

Other characteristics and advantages of the present invention will be clear from the following description with reference to the accompanying drawings in which:

FIG. 3 is a cross sectional view of a frame of an under mattress with an adjustable damping shims wherein the under mattress is delivered to a user; and FIGS. 3A and 3B are cross sectional and top views of a shim used with the under mattress of FIG. 3 during initial adjustment.

DESCRIPTION OF THE EMBODIMENT

Figure 1A:
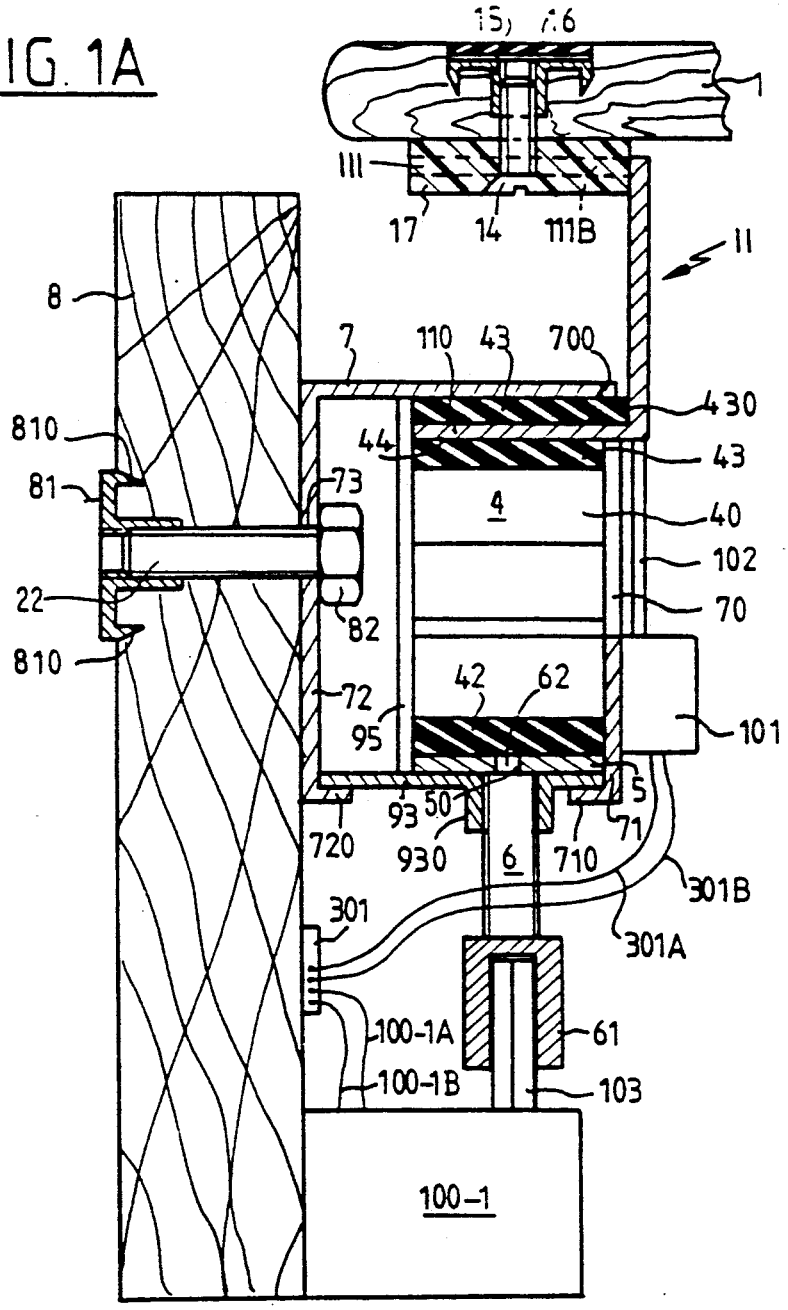
FIGS. 1A and 1B are respectively a cross sectional view and a front view of the frame of a slatted under mattress with adjustable damping for taking impressions to be used to adjust the positions of slats of a bed to be delivered to a user.
Figure 1B:
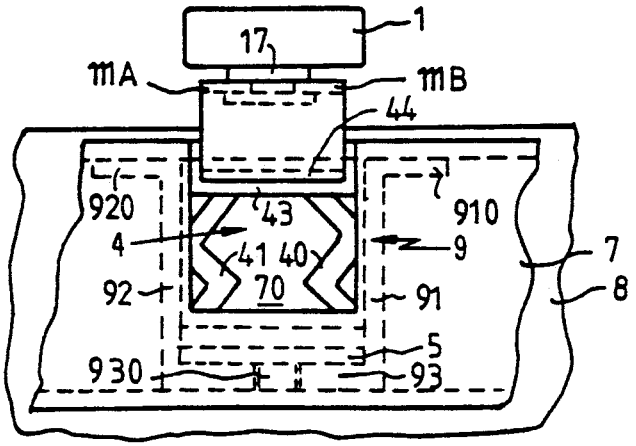

FIG. 1 is a cross sectional view of one embodiment of the impression-taking bed used in the device of the invention. Frame 8, extending around a slatted under mattress, i.e., box spring, supports chassis 7 formed of a U-shaped member with vertically extending spaced legs 71, 72 having upper faces against which bears plate 93, including horizontally extending aligned flanges or lips 720, 710 forming the central part of the U. In a way known per se, chassis 7 has portions mounted rigidly on frame 8 or pivoting portions to form, depending on the needs, inclinable surfaces at the head and foot of the bed. Chassis 7 may, in certain variants, play the role of frame 8. A side wall of chassis 7, at each slat, has an opening 70 preferably turned inwardly of frame 8; each opening is of a sufficient size to allow connection piece 11 to move between a position where resilient pad 4 is applied against the upper internal face of chassis 7 and another position where resilient pad 4 is completely crushed on support plate 5. At each opening 70, a cage is formed by a U-shaped piece, FIG. 1B, having parallel branches 91, 92 with ends bent back outwardly to form lateral flanges 910, 930. Flanges 910, 920 are welded to the central part of chassis 7 so that U-shaped channel 9 surrounds an opening. U-shaped piece 9 has a central part 93 including a tapped hole 930 to receive adjustment screw 6. Support plate 5 comprises a recess or hole 50 in which is housed a tapered point 62 or nipple at the end of screw 6 for adjusting the articulation rigidity of plate 5.

Resilient pad 4, formed of a material having adequate resiliency, includes wall 42 abutting against plate 5 and two lateral resilient legs 40, 41 each with a zig-zag profile. Legs 40 and 41 are disposed in the vicinity of the faces adjacent sides 92, 91 of cage 9. Pad 4 has a second bearing wall 43 for propping or pushing U-shaped strut 11 against the upper internal face of the central part of chassis 7. Wall 43 has an opening 44 of appropriate size for receiving strut 11, connected to slat 1. Branch 110 of strut 11, is housed in slot 44, whereas branch 111 (parallel to branch 110) includes teeth 111A, 111B and fits into a groove of block 17 connected to slat 1 by screw 14. Strut 11 includes a web connecting the ends of branches 111, 110. The web is oriented outwardly of the bed to provide transverse blocking of the slats with respect to frame 8.

Articulation is provided by resilient pad 4 and strut 11, fixedly connected to slat 1. Strut 11 abuts against the cage including channel 9. Articulation provided by pad 4 and strut 11 enables each bed slat to be moved vertically and rotated about an axis parallel to the slat axis.

In FIG. 1, only one upright side of the box spring frame is shown, but the structure on the other upright side of the frame is symmetrical with the illustrated upright side. Connecting strut 11 is secured to slat 1, for example, by nut-washer 16 and a screw with countersunk head 14. Chassis 7 is secured to frame 8 by screw 82 and nut-washer 81 with teeth 810 that bear into the wooden frame. Screw 22 passes through horizontally extending hole 73 in vertically extending wall 72 of chassis 7 separating the legs 40, 41 of resilient pad 4. Resilient pad 4 has spaced vertically extending side walls 40, 41 abutting against a pair of spaced lateral lips 95 extending perpendicularly to the central plate 93 of chassis 7. The entire structure previously described forms part of both an impression-taking bed and of a separate bed to be delivered to the customer, as described infra.

The impression-taking bed further comprises, for each slat 1 and the associated pad 4 and strut 11, a detector for the movement of the associated slat during loading. Each detector includes a motor and electric signal generating transducer, preferably a potentiometer, 101 connected to bus 301 by wires 301A and 301B. Vertically extending detecting means may for example be a sensor arm 102 which acts on potentiometer 101 to deliver a voltage proportional to the movement of slat 1. Alternatively the upper end of arm 102 may receive slat 1 directly. Transducer 101 may be other than a potentiometer, e.g., magnetic or electronic or any other means for obtaining a signal proportional to articulation of slat 1.

Motor 100-1, fixed to frame 8, comprises shaft 103 of appropriate shape and length to fit into a hollow blind hole in the hexagonal head of screw 61 so the screw and shaft 6 connected to it are rotated in response to the motor being driven. The length of shaft 103 and the depth of the blind hexagonal hole of screw 61 are selected as a function of the desired maximum travel for support plate 5 for the bottom face of pad 4. Motor 100-1, part of a reducer assembly, is controlled by a voltage applied by wires 100-1A, 100-1B of bus 301. A housing for bus 301 is fastened to frame 8.

Figure 2:
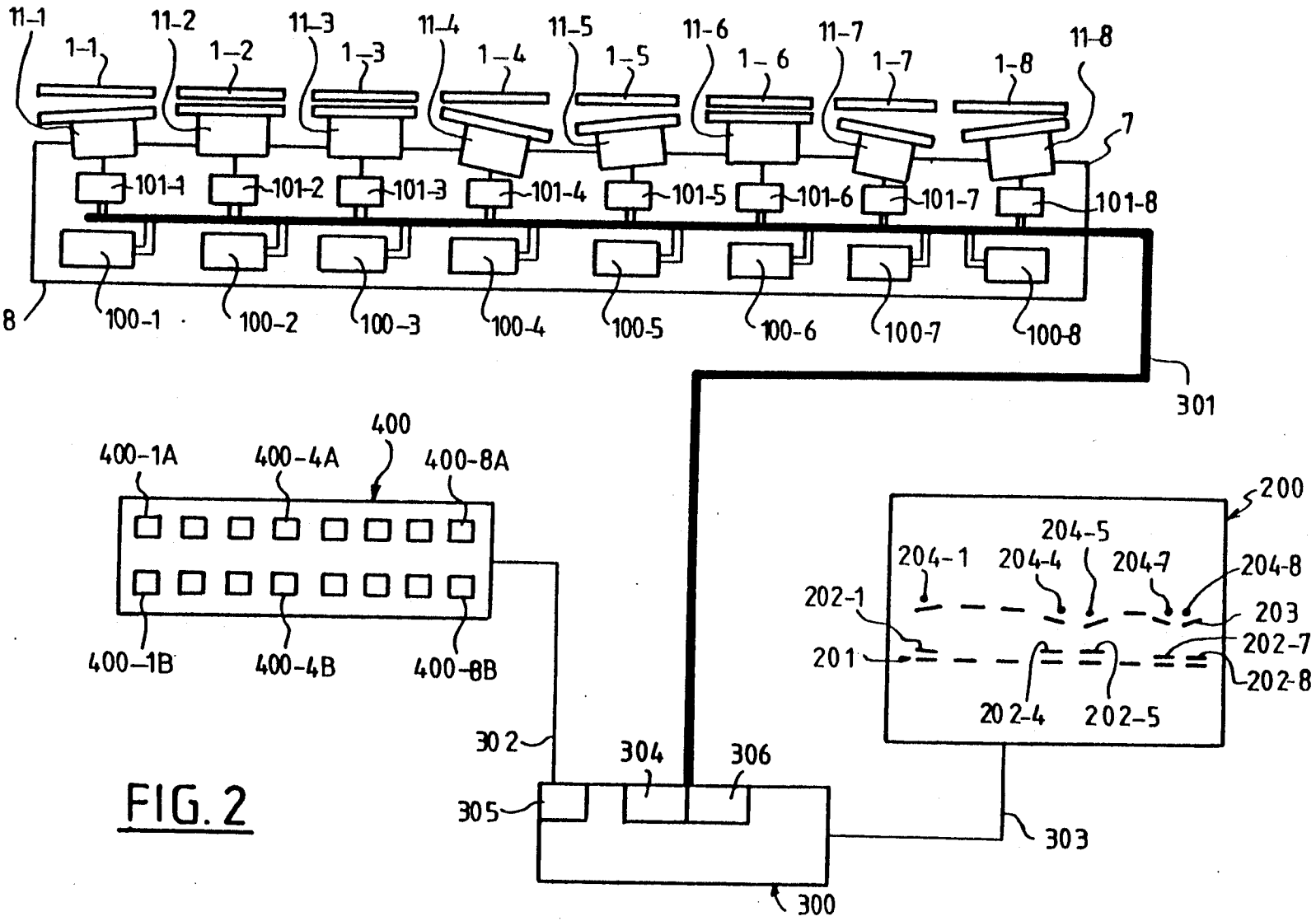
FIG. 2 is a schematic view of the impression-taking device for implementing the impression-taking method of the invention.

In FIG. 2 is shown the left-hand longitudinal member of a bed frame 8 having openings, corresponding with openings 70 for pads 4, to receive struts 11-1 through 11-8. The openings are disposed at regular horizontal intervals, in chassis 7 on frame 8. The openings enable articulation of struts 11-1 through 11-8 and corresponding slats 1-1 through 1-8. Struts 11-1 to 11-8 are illustrated in an exemplary position while a user is lying on a mattress (not shown) placed on an under mattress (not shown). The vertical movement of each strut 11-1 to 11-8 is detected by a corresponding potentiometer 101-1 to 101-8. Each of potentiometers 101-1 to 101-8 derives an analog signal indicative of the vertical movement of its associated slat; the signal is supplied by two wires to bus 301, thence to interface 306 for converting the analog signals into digital signals transmitted to a bus of central processing unit 300.

Central processing unit 300 comprises a microprocessor, having associated memories and programs, for example stored on a disk, for processing signals supplied to the bus transducers 101-1 to 101-8. Associated with each of articulation devices including struts 11-1 to 11-8 associated with slats 1-1 to 1-8 is a reducer assembly including one of motors 100-1 to 100-8 for driving one of the screws 6 for adjusting the articulation associated with the particular slat. A separate motor-driven reducer assembly is situated on each side of each of slats 1. Each of the motors 100-1 to 100-8 of the reducer assemblies is controlled by two wires 101-A, 101-B, extending from bus 301 and connected to an interface 304 for converting digital signals derived by the central processing unit into analog signals. The analog output signals of the converter supplied to bus 301 control motors 100-1 to 100-8.

A control box 400 comprises two rows of keys 400-1A to 400-8A and 400-1B to 400-8B. Key 400-1A controls rotation of motor 100-1 in the screwing-in direction of screw 6, i.e., drives plate 5 away from plate 93 forming the central part of U-shaped cage 9. Key 400-1B controls movement of motor 101-1 in the opposite direction. By actuating key 400-1A, the plate 5 for the articulation mechanism including strut 11-1 associated with each end of the slat 1-1 is raised to increase the articulated rigidity of slat 1-1 and consequently modify the comfort of the under mattress.

Central processing unit 300 and its associated software control, through a conventional interface, a display device formed by monitor 200 which displays at positions 203 the profile of the slatted under mattress when the latter is loaded by the user, i.e., customer. On monitor 200, the initial position of support plates 5 for adjusting the rigidity of the articulation is indicated by lines 201. The final positions of support plates 5, associated respectively with slats 1-1, 1-4, 1-5, 1-7, 1-8, are indicated by lines 202-1, 202-4, 202-5, 202-7 and 202-8. The final positions of slats 1-1, 1-4, 1-5, 1-7 and 1-8 are controlled by the user for maximum comfort. These movements of support plates 5 are determined, either by the actuation duration of the respective associated keys 400-1, 400-4, 400-5, 400-7 and 400-8, or by the signals delivered by rotary potentiometric transducers 101-1, 101-4, 101-5, 101-7 and 101-8 having rotations related to those of output shafts 103 of the motor-driven reducers. These movements of support plates 5 correspond with modifications of the profile of the under mattress shown by the dots 204-1, 204-4, 204-5, 204-7, 204-8, as defined by the signals derived from transducers 101-1, 101-4, 101-5, 101-7, 101-8. Thus, in response to activation of keys 400-1A to 400-8A and 400-1B to 400-8B of control box 400 the articulation rigidity for each of slats 1-1 to 1-8 may be adjusted to suit the user of a bed to be bought while the user is lying on the bed. Consequently the comfort of the bed is adjusted to the desires of the user who is able to determine the modified bed positions directly since he is lying on the bed. Once the customer is satisfied with the adjustments to fit his needs, the vendor validates them and the software of processor 300 calculates the values corresponding to the controlled movements. The system then displays these values in suitable form, e.g., in digital or color codes, or prints them on a sheet with the name of the customer, the reference of the bed, the slat numbers 1-1 to 1-8 and the code of a shim associated with each slat. A different shim is associated with each code to adjust the slat positions of the bed to be delivered.

FIG. 3 is a cross sectional view of an above described articulation device for providing the correct articulation rigidity associated with the impression-taking bed, but without detectors for slat movement. The structure illustrated in FIG. 3 is included in a bed to be delivered to a user. Basically plate 5 and strut 11 for each slat 1 are fixed in the bed to be delivered at positions determined with the apparatus of FIGS. 1 and 2. For each slat 1 having a position to be modified, a shim 500, FIGS. 3A and 3B, is prepared. The geometry of each shim 500 is determined with the apparatus of FIGS. 1 and 2. After each shim 500 has been prepared it is inserted into the structure illustrated in FIG. 3 to control the positions of plate 5, strut 11 and slat 1.

Assume that the apparatus of FIGS. 1 and 2 has determined that the shim 500 for controlling the position of slat 1-1 of the bed to be delivered has a thickness as shown in FIG. 3B. The top face of shim 500 is wedged against fixed horizontal surfaces of flanges 710, 720 while shoulders 5010 and 5020 of the shim bear against the top horizontal face of head 610 of screw 6. The walls of a vertically extending slot in shim 500 between shoulders 5010 and 5020 envelop lock nut 60 which bears on the edges of sleeve 930 that depends downwardly from fixed plate 93. The length of the threaded part of screw 6 is calculated as a function of the maximum travel of movable support plate 5. When head 610 of screw 6 is applied against shoulders 5010, 5020, with the top face of shim 500 abutting against flanges 710, 720, the position of support plate 5 is fixed at a location where the desired rigidity for the corresponding slat is obtained. Then lock nut 60 is tightened to avoid any untimely misadjustment. Shim 500 is then removed. After each of plates 5, struts 11 and slats 1 on both sides of the bed have been adjusted to correspond with the articulations of the bed determined by the shims corresponding to the codes associated with each of the articulations, the bed is delivered to the user.

In a variant for adjusting the bed to be delivered, from the position where screw head 610 is applied against lock nut 60 corresponding to the maximum travel of the support plate 5, a shim may be slid, through an opening in a shaped member 7, between support plate 5 and the upper face of plate 93. Screw 6 is then unscrewed to abut support plate 5 against shim 500. After tightening lock nut 60 shim 500 is removed.

Thus, the device has been described for taking impressions on a demonstration bed in a retail shop for adjusting the bed to be delivered in accordance with the wishes of the customer.

Any modifications within the scope of a man skilled in the art also form part of the scope of the invention.

We claim:

1. A method of taking impressions for a bed to be used by a user, the bed to be used having slats and spring-like support means for applying differing upwardly directed forces to bottom surfaces of different ones of the slats, the impressions being taken while a user of the bed is in a recumbent position on an under mattress of an impression taking bed supported by slats, the slats of the impression taking bed being supported by spring-like support means of the type which supports the slats of the bed to be used, the method comprising:

modifying the vertical position of differing ones of the spring-like support means of the impression taking bed to a position compatible with the user while the user is in said position on the impression taking bed, the vertical position being modified with respect to an initial adjustment position of the spring-like means for slats of the impression taking bed, and recording the amount by which the vertical position was modified for the spring-like support means of the impression taking bed to enable the vertical position of the spring-like support means of the bed to be used to be controlled.

2. The method of claim 1 further including controlling the geometry of an adjustment shim for each slat of the bed to be used in response to the recorded amount by which the vertical position of the spring-like support means was modified.

3. The method of claim 2 further comprising inserting the shim having the controlled geometry for each slat in a structure for controlling the vertical position of spring-like support means of the bed to be used by the user, and controlling the structure with the shim inserted therein so that spring-like support means in the bed to be used are vertically moved to positions corresponding to the recorded amounts.

4. The method of claim 3 further comprising locking each spring-like support means of the bed to be used at the position determined by the shim while the shim is inserted.

5. The method of claim 4 further comprising removing the shim from the vertical control structure for each slat after the spring-like support means has been locked in position.

6. The method of claim 4 wherein the control structure for each slat comprises a plate vertically adjustable with respect to a frame for the bed to be used, the plate being connected by a spring-like support means to a strut for changing the vertical position of the associated slat of the bed to be used, adjusting the vertical position of the plate and articulation of the strut while the shim in inserted between a fixed cage in which the plate is driven and a facing surface of an adjustment means for driving the plate, and then locking the plate in place to lock the spring-like support means in place.

7. A method of providing maximum comfort to a user of a bed to be used by the user of said bed, the bed to be used including: an under mattress, plural slats supporting the under mattress, and means for adjusting vertical support forces applied to the slats, the method comprising:

causing the user to be in a reclining position on an under mattress of a test bed different from the bed to be used by the user;

the test bed including: plural slats supporting the under mattress, means for monitoring the force exerted on the test bed slats by the user, and means for adjusting vertical support forces applied to the test bed slats;

while the user is in the reclining position on the test bed, adjusting the vertical support forces exerted on the test bed slats which enable the user to have maximum comfort, by activating the force adjusting means of the test bed, monitoring with the monitoring means the vertical support forces exerted on the test bed slats which enable the user to have maximum comfort; and recording an indication of the monitored forces applied to the slats of the test bed for use in controlling the adjusting means of the bed to be used to provide similar forces to the slats of the bed to be used.

8. The method of claim 7 wherein the means for adjusting the forces applied to the slats of the test bed includes a vertically extending spring-like member having a confined lower end and a confined upper end from which extends a rigid structure connected to drive one of the tested slats, the vertically directed force exerted on the slats of the test bed by said means for supporting being modified by adjusting the vertical position of the confined lower end of the spring-like member.

9. The method of claim 8 wherein the lower end vertical position of the spring-like member of the test bed is adjusted by activating a motor for driving the lower end to determine the correct position of the lower end relative to an initial lowest position for the spring-like member of the test bed, and adjusting slats in the bed to be used by biasing the lowest end of spring-like members of the bed to be used.

10. The method of claim 9 wherein the lower end of the spring-like members of the bed to be used is biased by providing a shim having a geometry to attain the correct bias, translating the lower end of the spring-like member of the bed to be used away from the initial lowest position therefor, and inserting the shim into the bed to be used between the lower end of the spring-like member and a structure defining the initial lowest portion for the spring-like member.

11. The method of claim 9 wherein the lower end is biased by translating a plate away from a member defining the initial position of the lower end of the spring-like portion.

12. The method of claim 11 wherein the plate is translated by turning a screw to which the plate is fixedly mounted.

13. The method of claim 7 further including controlling the means for adjusting of the bed to be used so vertical forces on the slats of the bed to be used are substantially the same as the monitored vertical support forces on the slats of the test bed.

14. The method of claim 13 wherein the means for adjusting the vertical support forces applied to the test bed and the bed to be used include for each bed a separate vertically extending spring-like member having a confined lower end and a confined upper end from which extends a rigid structure connected to drive a slat of the particular bed, adjusting the vertical position of the confined lower end of the spring-like member of the test bed to provide the vertical support forces on the test bed slats which enable the user to have maximum comfort, the monitored force being indicated by the vertical position of the lower end of the test bed spring-like structure, adjusting the vertical position of the confined lower end of a spring-like member of the bed to be used so it conforms substantially with the vertical position of a corresponding slat of the test bed as determined during the monitoring step.

15. The method of claim 14 wherein the lower end vertical position of the spring-like member of the test bed which results in maximum comfort is adjusted by activating a motor for driving the lower end to determine the correct position of the lower end relative to an initial lowest position for the spring-like member of the bed to be used.

16. The method of claim 15 wherein the lower end of the spring-like members of the bed to be used is biased by providing a shim having a geometry to attain the correct bias, translating the lower end of the spring-like member of the bed to be used away from the initial lowest position therefor, and inserting the shim into the bed to be used between the lower end of the spring-like member and a structure defining the initial lowest portion for the spring-like member.

17. The method of claim 16 wherein the lower end of the spring-like member of the bed to be used is biased by providing a shim having a geometry determined by the monitored position of the lower end of the spring-like member of the test bed, and inserting the shim in the bed to be used between the lower end of the spring-like member and a structure defining the initial lowest portion for the spring-like member.

* * * * *